US005467999A

United States Patent [19]

Valencic et al.

[11] Patent Number: 5,467,999

[45] Date of Patent: Nov. 21, 1995

[54] MASTER ARCHER TARGET

[75] Inventors: Michael Valencic; David Valencic, both of 212 Altermoor Dr., Natrona Heights, Pa. 15065

[73] Assignees: Michael Valencic; David Valencic, both of Natrona Heights, Pa.

[21] Appl. No.: 343,641

[22] Filed: Nov. 22, 1994

[51] Int. Cl.[6] ..... F41J 3/00

[52] U.S. Cl. ..... 273/402

[58] Field of Search ..... 273/348, 402, 273/408, 410, 407

[56] References Cited

U.S. PATENT DOCUMENTS 2,540,288 2/1951 Powers ..... 273/402

4,168,066 9/1979 Sole et al. ..... 273/402

4,189,146 2/1980 Warner ..... 273/408

4,281,836 8/1981 Black ..... 273/408

*Primary Examiner*—William H. Grieb

*Attorney, Agent, or Firm*—Michael Valencic; David Valencic

[57] ABSTRACT

The "Master Archer Target" is a 3-dimensional high impact plastic archery target with multiple open bulls-eyes of various sizes to provide a challenge from amateur to expert. By providing multiple bull-eyes, it prevents arrow damage by allowing adequate separation of arrows for each shot and forces the archer to improve their accuracy.

6 Claims, 1 Drawing Sheet

MASTER ARCHER TARGET

FIELD OF THE INVENTION

This invention relates to the sport of archery. This target is designed to develop one's skill in hunting or target shooting with a bow. The design of the target also eliminates arrow damage by giving the shooter multiple targets to aim at.

BACKGROUND OF THE INVENTION

1. Field of the Invention

This invention relates to archery targets and more specifically to the "Master Archer Target", a 3-Dimensional high impact plastic target with multiple bulls-eyes.

2. Description of the Prior Art

Current targets in existence with either single or multiple bulls-eyes are 2-dimensional and their borders are defined by paint, ink, or some other type of drawing. The problems with these targets are that they become totally defaced by the repeated number of shots to the same general area. Also, because the bulls-eyes remain in a fixed position, the backstop for the target is also severely damaged or weakened to the point of ineffectiveness. Another problem with these types of targets, because of a fixed, singular, or low number of bulls-eyes, the possibility of arrow damage is greatly increased due to the fact that all shots are centered to the same point. Although these targets do provide a focus point and the multiple bulls-eyes provide some arrow separation, there would be an improvement to these designs by having a target that can be moved from its background, and have several specific bulls-eyes to focus on that would force the archer to shoot with more precision.

SUMMARY OF THE INVENTION

The "Master Archer target" is a 3-D molded plastic target with 15 individual open bulls-eyes. It is constructed of a high-impact plastic which is virtually indestructible. The advantages with this type of target are numerous. Because of its high impact, open bulls-eye design, there is no chance of defacing or shooting away the target. It can easily be mounted to any backstop and when the backstop becomes weakened due to numerous shots, the target can simply be moved a few inches to provide a solid stop again. By having 15 separate bulls-eyes of 3 different sizes, it not only provides adequate separation to prevent arrow damage, it also forces the archer to shoot with more precision. This in turn helps to develop shooting skills and provides a challenge to the amateur or expert.

BRIEF DESCRIPTION OF THE DRAWINGS

To promote and to ease the understanding of the following text, the d "rings" has been substituted for the word "Bulls-eyes".

Figure 1:
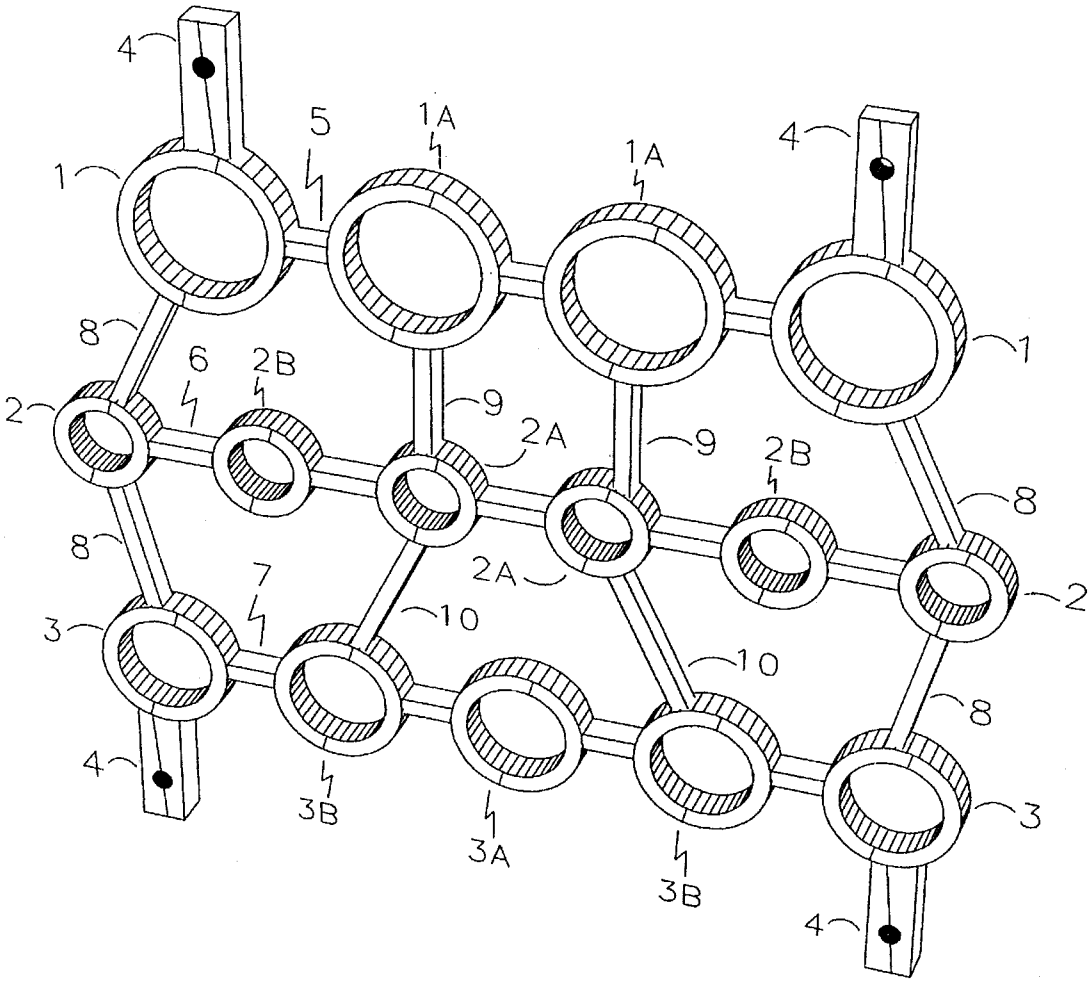
FIG. 1 is a perspective of a one piece three dimensional archery target.

The "Master Archer target" is a series of individual rows of rings, varying in three different sizes. All of the rings are interconnected, vertically and horizontally. There are four anchor points, one on each corner ring of the target, to secure the target to a proper backstop. The "Master Archery Target" measures nineteen inches high, twenty and one half inches long, and one half of an inch wide. The largest ring has a three inch inside diameter and is the top of the target. This row consists of four equally spaced rings. The smallest row of rings has a one and one eighth inch inside diameter and is the center row of the archery target. This row consists of six equally spaced rings. The bottom row of rings, consisting of five equally spaced rings, have an inside diameter of two inches. The archery target is made of high impact plastic.

DESCRIPTION OF THE PREFERRED EMBODIMENT

For the purposes of promoting an understanding of the principles of the invention, reference will now be made to the embodiment illustrated in the drawing and specific language will be used to describe the same. It will be understood that no rights have been waived and no limitations have been placed on the scope of the invention. Future modifications of the geometric design, and such further applications of the principles of the invention as illustrated therein being contemplated as would normally occur to one skilled in the art to which the invention relates.

To promote and to ease the understanding of the following text the word "rings" has been substituted for the word "Bulls-eyes".

Referring to FIG. 1 there is illustrated a one piece three dimensional archery target made of high impact plastic. The target consists of three rows of rings with each row having a different size of equally spaced rings. The first row of rings 1. and 1A. is the top of the target and the largest row of rings. The inside diameter of 1. and 1A. is three inches. The outside diameter of 1. and 1A. is three and five eights inches. The width of 1. and 1A. is one half of an inch. A spacer 5. measuring five sixteenth by one half by one and one half inches equally separates the top four rings 1. and 1A. The second row consists of six equally spaced rings 2. 2A. 2B. measuring one and one eighth inches for the inside diameter. The outside diameter of 2. 2A. 2B. is one and three fourth of an inch. The width of 2. 2A. 2B. is one half of an inch. Rings 2. 2A. 2B. are equally separated by a spacer 6. measuring five sixteenth by one half by two inches. The third row of rings 3. 3A. 3B. is the bottom of the target and have an inside diameter of two inches. The outside diameter of 3. 3A. 3B. is two and five eights inches. The width of rings 3. 3A. 3B. is one half of an inch. Rings 3. 3A. 3B. are equally spaced and separated by 7. a spacer measuring five sixteenth by one half by one and one half inches. The outside corner rings 1. and 3. have a bracket 4. located on the top of ring 1. and the bottom of ring 3. perspectively. Bracket 4. has a prepunched five sixteenth inch hole centered three fourth of an inch from the top. Bracket 4. measures one half by five eights by three inches. Bracket 4. is used to secure the target via anchor pins to a proper back stop. Rings 1. 2. 3. are connected by a spacer 8. measuring five sixteenth by one half by two and five eights inches. Rings 1A. and 2A. are connected by 9. a spacer measuring five sixteenth by one half by two and five eights inches. Rings 2A. and 3B. are connected by 10. a spacer measuring five sixteenth by one half by two and five eights inches. Each row of rings, 1. 1A., 2. 2A. 2B., 3. 3A. 3B., have a vertical separation of two and one half inches. The top row of combined rings 1. 1A. and spacers 5. are nineteen inches long. The center row of combined rings 2. 2A. 2B. and spacers 6. are twenty and one half inches long. The bottom row of combined rings 3. 3A. 3B. and spacers 7. are nineteen and one eighth inches long. The height of the target from the top to the bottom of bracket 4. perspectively is nineteen inches. Each row of rings 1. 1A. 2. 2A. 2B. 3. 3A. 3B. will be color coded to our discretion.

What is claimed is:

1. An archery target, comprising;

a molded, one-piece construction of high-impact plastic, said target having a plurality of open bulls-eyes of three different sizes, each size of bulls-eyes being in a horizontal line, one size per line, said target being adapted to be mounted to desired backstop, so that arrow may pass through the open bulls-eyes to lodge in the backstop, whereby when said backstop becomes weakened or disfigured due to repeated shots, said target can be relocated to another part of the backstop or to another backstop.

2. The archery target of claim 1, wherein there are fifteen open bulls-eyes, consisting of, four on the top, six in the center, and five on the bottom row.

3. The archery target of claim 1, wherein each horizontal row of open bulls-eyes has a different diameter.

4. The archery target of claim 1, wherein each row of open bull-eyes has a specific color.

5. The archery target of claim 1, wherein the open bulls-eyes provide arrow separation to prevent arrow damage.

6. The archery target of claim 1, will increase one's shooting proficiency.

* * * * *